US005873309A

United States Patent [19]

Mack et al.

[11] Patent Number: 5,873,309

[45] Date of Patent: Feb. 23, 1999

[54] ROTARY PRINTING MACHINE WITH A DEVICE FOR TREATING THE SURFACE OF SHEETS

[75] Inventors: Richard Burkhard Mack, Brühl; Rolf Müller, Nussloch, both of Germany

[73] Assignee: Heidelberger Druckmaschinen Aktiengesellschaft, Heidelberg, Germany

[21] Appl. No.: 897,739

[22] Filed: Jul. 21, 1997

[30] Foreign Application Priority Data

Jul. 20, 1996 [DE] Germany ..... 196 29 370.7

[51] Int. Cl.[6] ..... B41F 23/04

[52] U.S. Cl. ..... 101/424.1; 101/232

[58] Field of Search ..... 101/177, 181, 101/183, 216, 232, 416.1, 424.1

[56] References Cited

U.S. PATENT DOCUMENTS 4,732,084 3/1988 Wirz .

FOREIGN PATENT DOCUMENTS 0 378 826 A2 7/1990 European Pat. Off. .
0378 826 A3 7/1990 European Pat. Off. .
510 456 10/1930 Germany .
688935 3/1940 Germany .
6603661U1 5/1966 Germany .
123 071 11/1976 Germany .
3413159C2 9/1986 Germany .
3632744A1 5/1987 Germany .
42 19 116 A1 12/1993 Germany .
43 42 203 A1 6/1995 Germany .
4436955A1 4/1996 Germany .
95/29813 11/1995 WIPO .

*Primary Examiner*—Ren Yan
*Attorney, Agent, or Firm*—Herbert L. Lerner; Laurence A. Greenberg

[57] ABSTRACT

A rotary printing machine with a sheet-surface treating device disposed between a last cyclically operating printing unit and a device for conveying sheets on a sheet pile, the sheet-surface treating device including at least one fixed drier past which the sheets are guidable, includes at least one module composed of two rotating conveying elements having a like circumferential speed for transporting the sheets along the sheet-surface treating device, the conveying elements carrying grippers for grasping a respective leading edge of one of the sheets, the sheets being supplied to the module and discharged from the module, respectively, during a rotation of the grippers in accordance with a printing cycle, a plurality of gripper arms, the grippers of a respective conveying element disposed first along a conveying path of the sheets being carried by at least one of the gripper arms, guiding elements for freely guiding the sheets otherwise, the grippers of the conveying element disposed second along the conveying path of the sheets being carried by at least one of the gripper arms, and rotating curved supporting elements arranged in cicumferential direction between the gripper arms so that the sheets are disposable thereon.

2 Claims, 1 Drawing Sheet

1
2
3
4
5
6
7
8
9
10
11
12
13
14
15
16
17
18
19
20
21
22
23
24
25
26
27
28
29
30
31
32
33
34
35
36
49
50
51
52
53
54
55
56

37
38
39
40
41
42
43
44
45
46
47
48
19 (31,32)

ROTARY PRINTING MACHINE WITH A DEVICE FOR TREATING THE SURFACE OF SHEETS

BACKGROUND OF THE INVENTION

FIELD OF THE INVENTION

The invention relates to a rotary printing machine with a device for treating the surface of sheets and, more particularly, to a sheet-fed rotary printing machine having a delivery wherein at least one drier for varnish or printing ink is provided. In such rotary printing machines, conveying elements, such as chain conveyors or transfer drums, for example, which have grippers assembled thereon, are provided in the delivery, and have thermal drying devices, cooling devices, powdering devices or redampening devices assigned thereto for treating the surface of the sheets. The printed surface of the sheets are prevented thereby from smearing or smudging, and the sheets are prevented from sticking to one another.

At high machine speeds, in order to achieve the desired effect, it is necessary to employ a large amount of energy in the treatment of the surface and for the energy-active stage to have dimensions which are as large as possible. Heretofore known devices for treating the surface of the sheets have therefore require a great amount of space. For example, the construction shown in the published German Patent Document DE 66 03 661 U1 requires a relatively great erection height in order to accommodate vertically arranged chain conveyors. For a web-fed printing machine having a modular construction, the published European Patent Document WO 95/29813 A1 provides, for each module, a drier which is assigned to a web length running rectilinearly in a vertical direction.

In the construction shown in German Patent 688,935, a drying drum with a large circumference is used, the dry air serving for the drying being also effective during the rotation of the drum. The dwell time of the fresh printing ink in the drying air may be further lengthened if the diameter of the drying drum is increased in size. In addition to the large volume which has to be provided for the drying drum, a disadvantage arises in that the print on the surface of the sheets is damaged by resting on screen-like supporting elements. The supporting elements impair the effectiveness of the drying air supplied. Moreover, the provision of a co-rotating drier device is complicated from a construction standpoint.

SUMMARY OF THE INVENTION

It is accordingly an object of the invention to provide, with relatively little outlay in terms of material and cost, a rotary printing machine with a sheet-surface treating device having a relatively small overall size, so that the print on the sheets remains virtually uninfluenced thereby. With the foregoing and other objects of the invention, there is provided a rotary printing machine with a sheet-surface treating device disposed between a last cyclically operating printing unit and a device for conveying sheets on a sheet pile, the sheet-surface treating device including at least one fixed drier past which the sheets are guidable, comprising at least one module composed of two rotating conveying elements having a like circumferential speed for transporting the sheets along the sheet-surface treating device, the conveying elements carrying grippers for grasping a respective leading edge of one of the sheets, the sheets being supplied to the module and discharged from the module, respectively, during a rotation of the grippers in accordance with a printing cycle, a plurality of gripper arms, the grippers of a respective conveying element disposed first along a conveying path of the sheets being carried by at least one of the gripper arms, guiding elements for freely guiding the sheets otherwise, the grippers of the conveying element disposed second along the conveying path of the sheets being carried by at least one of the gripper arms, and rotating curved supporting elements arranged in cicumferential direction between the gripper arms so that the sheets are disposable thereon.

In accordance with another feature of the invention, a drier is disposed within a path of rotation of the grippers of the respective conveying element which is disposed first along the conveying path of the sheets, and a further drier is provided outside the path of rotation of the grippers of the respective conveying element which is disposed second along the conveying path of the sheets.

In accordance with another feature of the invention, two of the modules are serially disposed, and a powdering device is provided for the respective conveying element disposed last along the sheet-conveying path adjacent to a drier acting outside the path of rotation, the powdering device being located downstream from the last-mentioned drier.

In accordance with a concomitant feature of the invention, the rotary printing machine includes two printing units, the at least one module being located downstream from a last one of the printing units, the device for treating the surface of the sheets being disposed between the two printing units, and further includes respective modules provided in the printing units and in the device for treating the surface of the sheets, in addition to the at least one module located downstream from the last one of the printing units.

The modular design allows for a high degree of repetitive or reiterative parts at low cost. That conveying element of a module which is disposed first along the conveying path of the sheets has only gripper arms with grippers which can be mounted rotatably by relatively simple means. Because the sheets, when being conveyed, are held only by the leading edge thereof on the first conveying element and are otherwise guided freely, the printing ink on the last-printed side of the sheets can be dried without any smearing. When the sheets are transferred from the grippers of the first conveying element of the respective module to the second conveying element and are transported on the second conveying element, the sheet side dried in the first conveying element during transport rests on supporting elements. In addition, the supporting elements may be constructed so as to be smear-free on the surface thereof. The conveying elements of the modules occupy only a small volume. The effect of the device assigned to the conveying elements may be further improved by connecting the modules serially. By transporting the sheets along circular paths, the sheet-surface treating device according to the invention takes up less overall space to achieve the same effect than corresponding devices with chain grippers which have transport paths running virtually rectilinearly.

Other features which are considered as characteristic for the invention are set forth in the appended claims.

Although the invention is illustrated and described herein as embodied in a rotary printing machine with a device for treating the surface of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings wherein:

DESCRIPTION OF THE PREFERRED EMBODIMENTS

Figure 1:
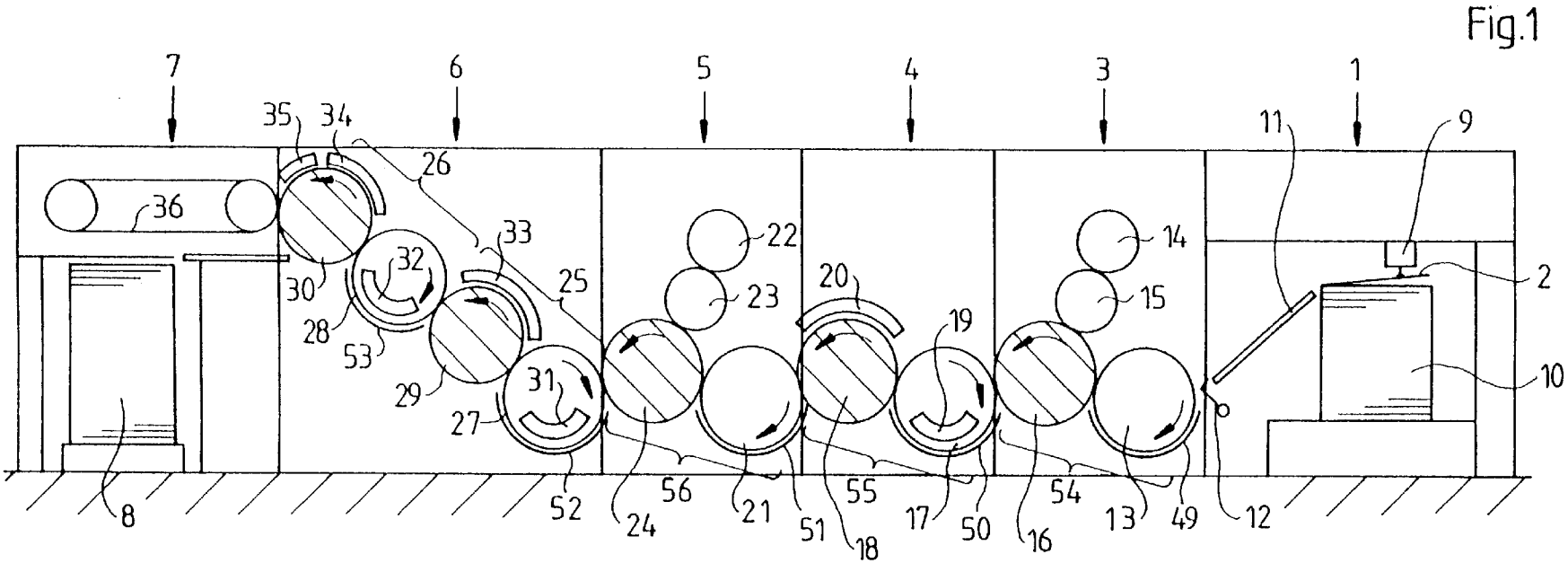
FIG. 1 is a diagrammatic side elevational view of a rotary printing machine with a device for treating the surface of sheets, which is constructed in accordance with the invention.

Referring now to the drawings and, first, particularly to FIG. 1 thereof, there is shown therein a printing machine with a device 1 for supplying sheets 2 to a first printing unit 3. The first printing unit 3 is followed by a drier 4 and a further printing unit 5. The printing unit 5 is followed, in turn, by a device 6 for treating the surface of the sheets 2, the device 6 being thereafter followed by a device 7 for conveying the sheets 2 to a sheet pile or stack 8.

The sheet-supplying device 1 includes a device 9 for separating or singling the sheets 2 from a sheet pile or stack 10. The sheets 2 conveyed onto a table 11 are transferred to a first rotary conveyor 13 of the printing unit 3 by a gripper device 12. The printing unit 3 is provided inter alia with a form cylinder 14, a transfer cylinder 15 and an impression cylinder 16, in a conventional arrangement. The drier 4 is made up of a rotary conveyor 17 and a transfer drum 18 which have assigned thereto, respectively, an internal and an external thermal drying device 19 and 20. The printing unit 5 is constructed in a manner similar to that of the printing unit 3 and includes a rotary conveyor 21, a form cylinder 22, a transfer cylinder 23 and an impression cylinder 24. The device 6 for treating the surface of the sheets 2 includes two modules 25 and 26 which are serially connected and, respectively, composed of a rotary conveyor 27, 28 and a transfer drum 29, 30. Thermal drying devices 31 and 32 are arranged in the rotary conveyors 27 and 28. Further thermal drying devices 33 and 34 acting from the outside are provided on the transfer drums 29 and 30. A powdering appliance 35 is assigned to the transfer drum 30 downstream of the thermal drying devices 34 along the sheet run or travel path. The device 7 for conveying the sheets 2 to the sheet pile or stack 8 is provided with a system having an endless chain conveyor 36. The sheets 2, in order to be deposited on the sheet pile or stack 8, are dropped from grippers provided on gripper bars, which are not further illustrated in the interest of clarity, the gripper bars being joined with the chains of the chain conveyor 36.

Figure 2:
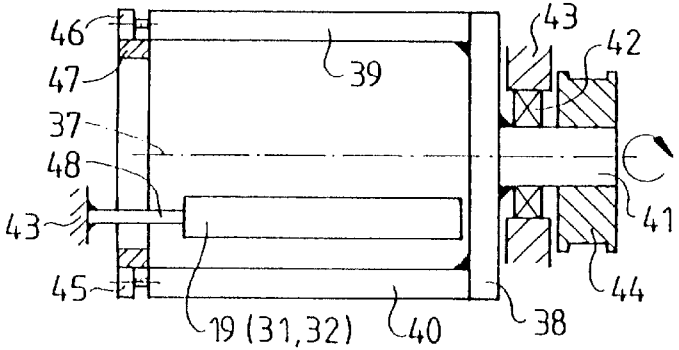
FIG. 2 is an enlarged sectional view of FIG. 1 taken along the line II—II and showing a conveying element with an internal drier.

The rotary conveyors 13, 17, 21, 27 and 28 arranged in the printing machine have the general construction shown in FIG. 2. Fastened to a beam 38 rotatable about an axis 37 are two gripper arms 39 and 40 whereon grippers are arranged which hold the sheets 2 at the leading edge thereof. The beam 38 is connected to a shaft 41 which is seated in a roller bearing 42 fastened in a frame 43 of the printing machine. A gearwheel 44 seated on the shaft 41 serves as the drive. The gripper arms 39 and 40 are supported at respective free ends thereof by rollers 45 and 46, respectively, on a ring 47 fixed to the machine frame 43. The respective thermal drying device 19, 31, 32 projects through the ring 47 into a region of rotation of the gripper arms 39 and 40. A holding element 48 for the respective thermal drying device 19, 31, 32 is anchored on the machine frame 43. Each of the rotary conveyors 13, 17, 21, 27 and 28 has a respective dish-shaped guide element 49, 50, 51, 52, 53 assigned thereto which is arranged on the outside along the conveying or travel path of the sheet 2. The hereinafore-described printing machine exhibits a strict modularity. In addition to the modules 25 and 26 in the device 7 for treating the surface of the sheets 2, the pairs composed of a respective rotary conveyor 13, 17, 21 and of the respective downstream impression cylinder 16, 24 or transfer drum 18 form a respective module 54, 55, 56. A favorable ratio between the stage length required for treating the surface of the sheet 2 and the occupied volume exists. The modules 25, 26, 54, 55 and 56 may each be encased independently, with the result that airflows assisting the treatment and transport of the sheets 2 can be generated. The encasing of the modules 25, 26, 54, 55 and 56 gives rise to closed-off units which do not allow any adverse effects to be imposed on themselves and from which no adverse effects are imposed on other units. Examples which may be mentioned are the swirling of powder particles or the thermal effect of the thermal drying devices 19, 20, 31, 32, 33 and 34 which have an effect essentially within one of the modules 25, 26, 54, 55 and 56. The thermal drying devices 19, 20, 31, 32, 33 and 34 and the powdering appliance 35 may be connectable and disconnectable. The printing machine thereby exhibits great flexibility which is required in order to execute printing orders in first-form or recto printing and in recto/verso or first-form and perfecter printing. The modules 25, 26, 53, 55 are 56 are exchangeable, and the thermal drying devices 19, 20, 31, 32, 33 and 34 assigned thereto and the powdering appliance 35 are combinable in any manner desired, so that it is possible for printing material, the type of printing ink and varnish and the type of thermal radiation source to be coordinated with one another.

The invention is not restricted to the printing machine shown in the exemplary embodiment. The invention may likewise by used in printing machines which have more than two printing units. The drying devices which may be employed are not only infra-red, but also ultra-violet hot-air drying systems or cooling systems.

There are claimed:

1. A rotary printing machine, comprising a cyclically operating printing unit, a device for conveying sheets, transported along a sheet transport path, to a sheet pile, at least two modules for treating a surface of the sheets, each of said modules disposed along the sheet transport path and composed of two rotating conveying elements defining a conveying path and having a like circumferential speed for transporting the sheets along said modules, said conveying elements carrying grippers for grasping a respective leading edge of one of the sheets, the sheets supplied to each of said modules and discharged from each of said modules, respectively, during a rotation of the grippers in accordance with a printing cycle, a plurality of gripper arms, the grippers of a respective conveying element disposed first along the conveying path of the sheets being carried by at least one of said gripper arms, guiding elements for freely guiding the sheets otherwise, the grippers of said conveying element disposed second along the conveying path of the sheets being carried by at least one of said gripper arms, rotating curved supporting elements arranged in circumferential direction between said gripper arms for receiving the sheets thereon, a drier disposed within a path of rotation of said grippers of said respective conveying element disposed first along the conveying path of the sheets, a further drier disposed outside the path of rotation of said grippers of said respective conveying element disposed second along the conveying path of the sheets, and a powdering device for the respective conveying element disposed last along the sheet-conveying path adjacent said further drier, said powdering device located downstream of said further drier.

2. The rotary printing machine according to claim 1, wherein said cyclically operating printing unit is a first cyclically operating printing unit and including a second cyclically operating printing unit, at least one of said at least two modules located downstream from said first printing unit, at least on of said two modules being disposed between said first and said second printing units, and one of said at least two modules provided in each of said printing units.

* * * * *